US011558705B2

(12) United States Patent
Straeussnigg et al.

(10) Patent No.: US 11,558,705 B2
(45) Date of Patent: Jan. 17, 2023

(54) SYSTEM AND METHOD FOR A DIGITAL CALIBRATION FILTER DEVICE

(71) Applicant: Infineon Technologies AG, Neubiberg (DE)

(72) Inventors: Dietmar Straeussnigg, Villach (AT); Alessandro Caspani, Villach (AT); Andreas Wiesbauer, Poertschach (AT)

(73) Assignee: Infineon Technologies AG, Neubiberg (DE)

( * ) Notice: Subject to any disclaimer, the term of this patent is extended or adjusted under 35 U.S.C. 154(b) by 958 days.

(21) Appl. No.: 16/229,916

(22) Filed: Dec. 21, 2018

(65) Prior Publication Data

US 2019/0200147 A1 Jun. 27, 2019

(30) Foreign Application Priority Data

Dec. 21, 2017 (DE) ..... 102017223496.2

(51) Int. Cl.
*H04R 29/00* (2006.01)
*H04R 19/04* (2006.01)

(52) U.S. Cl.
CPC ..... *H04R 29/004* (2013.01); *H04R 19/04* (2013.01); *H04R 2201/003* (2013.01)

(58) Field of Classification Search
CPC . H04R 29/004; H04R 19/04; H04R 2201/003
See application file for complete search history.

(56) References Cited

U.S. PATENT DOCUMENTS 7,329,555 B1 * 2/2008 Padmanabhan ..... B81C 1/00246 257/E21.499
2007/0258597 A1 * 11/2007 Rasmussen ..... H04R 29/006 381/26
2010/0232623 A1 * 9/2010 Martin ..... H04R 29/001 381/96

(Continued)

FOREIGN PATENT DOCUMENTS

CN 101860374 A 10/2010
CN 102594346 A 7/2012

(Continued)

OTHER PUBLICATIONS

Gupta, Sourabh et al., "Correcting the Low-Frequency Response of the ADS42LBxx, ADS42JBxx for Time-Domain Applications," Texas Instruments, Application Report, SBAA220, May 2016, 10 pages.

(Continued)

*Primary Examiner* — Daniel R Sellers
(74) *Attorney, Agent, or Firm* — Slater Matsil, LLP

(57) ABSTRACT

In accordance with an embodiment, a system includes a digital calibration filter device configured to receive a digital input signal based on a sensor output signal from a sensor, receive a sensor-specific control signal, and perform digital filter processing of the digital input signal to produce a calibrated output signal, wherein the digital filter processing is based on the sensor-specific control signal; and a control device configured to select the sensor-specific control signal from a plurality of sensor-specific control signals based on an ascertained influencing parameter, and provide the sensor-specific control signal to the digital calibration filter device.

29 Claims, 8 Drawing Sheets

(56) References Cited

U.S. PATENT DOCUMENTS

| | | | | |
|---|---|---|---|---|
| 2012/0106749 | A1* | 5/2012 | Buck | H04R 3/005 381/66 |
| 2012/0269363 | A1 | 10/2012 | Suvanto | |
| 2018/0084343 | A1* | 3/2018 | Straeussnigg | H04R 29/004 |
| 2018/0308467 | A1* | 10/2018 | Yamkovoy | G10K 11/178 |

FOREIGN PATENT DOCUMENTS

| | | | |
|---|---|---|---|
| CN | 103560791 | A | 2/2014 |
| CN | 104176634 | A | 12/2014 |
| DE | 102016117587 | B3 | 3/2018 |

OTHER PUBLICATIONS

Infineon, "High performance digital XENSIV MEMS microphone," IM69D130, Data Sheet, www.infineon.com, Dec. 19, 2017, 16 pages.

* cited by examiner

SYSTEM AND METHOD FOR A DIGITAL CALIBRATION FILTER DEVICE

This application claims the benefit of German Patent Application No. 102017223496.2, filed on Dec. 21, 2017, which application is hereby incorporated herein by reference in its entirety.

TECHNICAL FIELD

Exemplary embodiments relate to a processing device, a mobile device having the processing device and a method for calibrating a sensor output signal. Exemplary embodiments further relate to a processing device and a corresponding method for calibrating the frequency response of an output signal from a sensor, such as e.g. an MEMS sensor, to reduce the dependency of a sensor output signal from the sensor on an external influencing variable, such as e.g. the ambient temperature, in order to obtain an optimized or at least improved frequency response for the sensor output signal.

BACKGROUND

Sensor arrangements, such as e.g. MEMS sound transducers or MEMS microphones, are used for recording ambient noise or ambient sound. To provide a good level of quality for the recorded ambient sound or to meet customer requirements, a high level of linearity, a high signal-to-noise ratio SNR or concordance of the sensor output signal with a prescribed frequency response of the sound transducer may be required.

Real sound transducers have a frequently still considerable variation in the frequency response, for example owing to process variations during manufacture or owing to package variations or perhaps owing to ambient influences during operation of the sound transducer.

FIGS. 1*a*-1*b* show a graph 100 depicting the amplitude response 104 in dB (decibel) units as a function of the frequency 102 of the sensor output signals from a sound transducer for different temperatures $T_1$-$T_4$. FIGS. 1*a*-1*b* reveal that in particular the lower frequency response up to a frequency $f_B$ of approximately 200 Hz (see range B) is affected by the variation in the amplitude response over temperature.

In some applications, ambient sound is captured and evaluated using multiple microphones at the same time. To this end, the microphones are arranged in a microphone array in a specific, geometric arrangement in relation to one another, for example, in order to achieve what is known as "beamforming" for example. In this case, the individual microphones should have no or only slight variations in terms of frequency response. In particular the lower frequency range is then relevant for many microphone applications, the LFRO (Low Frequency Roll-off) property being referred to in this context. The LFRO property of a microphone in this case denotes, by way of example, the gradient of the transfer function over frequency in the low frequency range of the microphone, e.g. in the range up to 100 or 200 Hz. Real microphones have a significant variation in the LFRO owing to ambient influences, such as e.g. changes of temperature, as can be seen from FIGS. 1*a*-1*b*. FIGS. 1*a*-1*b* show the variation in the amplitude response of a microphone for a temperature variation $T_1$-$T_4$ from −20° C. to +70° C. by way of example.

Attempts are currently being made to use circuitry measures on the sensor arrangement to keep the variation in the frequency response of the sensor output signal as small as possible. This circuitry approach is subject to limits, however, which mean a corresponding level of additional extra sophistication for circuitry.

SUMMARY

A processing device comprises a digital calibration filter device configured to receive a digital input signal that is based on a sensor output signal from a sensor in order to take a sensor-specific control signal as a basis for performing a digital filter processing of the digital input signal in order to provide a calibrated output signal, and a control device configured to select the sensor-specific control signal from a plurality of sensor-specific control signals on the basis of an ascertained influencing parameter and to provide said sensor-specific control signal to the digital calibration filter device.

In accordance with a further embodiments, a mobile device includes a sensor; a digital calibration filter device coupled to the sensor, the digital calibration filter device configured to receive a digital input signal based on a sensor output signal from the sensor, receive a sensor-specific control signal, and perform digital filter processing of the digital input signal to produce a calibrated output signal, wherein the digital filter processing is based on the sensor-specific control signal; a control device configured to select the sensor-specific control signal from a plurality of sensor-specific control signals based on an ascertained influencing parameter, and provide the sensor-specific control signal to the digital calibration filter device; and an influencing variable sensor device coupled to the control device, the influencing variable sensor device configured to provide the ascertained influencing parameter of the sensor to the control device.

In accordance with another embodiment, a method for calibrating a sensor output signal from a sensor includes ascertaining an influencing parameter of the sensor; selecting a control signal from a plurality of control signals based on the ascertained influencing parameter, wherein a prescribed frequency response of the control signal is dependent on the ascertained influencing parameter of the sensor; adjusting a transfer function of a digital filter based on the selected control signal; and digital filtering an output signal of the sensor according to the adjusted transfer function to provide a calibrated output signal using the digital filter, wherein the digital filter utilizes at least two filter coefficients.

BRIEF DESCRIPTION OF THE DRAWINGS

Exemplary embodiments of apparatuses and/or methods are described in more detail below by way of example with reference to the accompanying figures and drawings, in which.

DETAILED DESCRIPTION OF ILLUSTRATIVE EMBODIMENTS

Figure 1A:
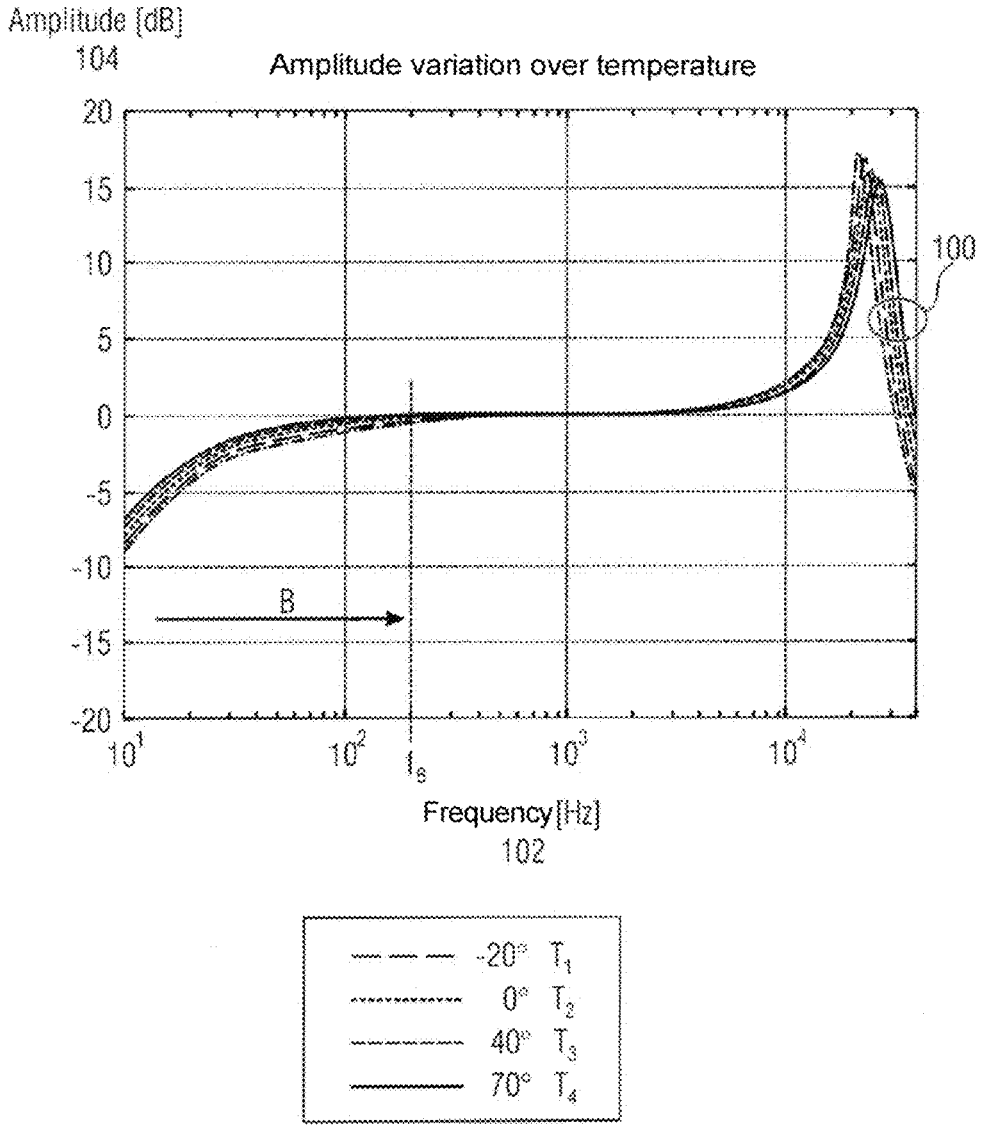
FIG. 1*a* shows a graph to depict the variation in an exemplary amplitude response over temperature for a sensor output signal without adaptation of the frequency response.

Various exemplary embodiments will now be described in more detail with reference to the accompanying drawings, which depict a few exemplary embodiments. The thicknesses of lines, layers and/or regions may be exaggerated in the figures for clarification purposes.

While exemplary embodiments are suitable for various modifications and alternative forms, accordingly exemplary embodiments of same are shown by way of example in the figures and described thoroughly here. It goes without saying, however, that the intention is not to limit exemplary embodiments to the specific forms disclosed, rather on the contrary the exemplary embodiments are intended to cover all modifications, counterparts and alternatives that fall within the scope of the disclosure. Throughout the description of the figures, identical reference signs refer to identical or similar elements.

In the field of sensors, there is a constant need for sensor elements, such as e.g. MEMS sound transducers, and also corresponding evaluation methods that capture the desired measured variables, such as e.g. ambient sound, with a sufficiently high level of accuracy and reproducibility.

In various embodiments, a programmable, digital and e.g. recursive filter or calibration filter is employed in order to compensate for a frequency variation in the sensor output signal from a sensor, such as e.g. an MEMS sensor, MEMS sound transducer or MEMS microphone that is dependent on an external influencing variable. The external influencing variable can be considered to be a temperature of the sensor itself or a temperature of the ambient atmosphere of the sensor, or perhaps a present humidity, a present air pressure or a present gas concentration in the ambient atmosphere of the sensor.

A processing device 200 for calibrating an e.g. analog sensor output signal $S_{OUT}$ will now be described below on the basis of FIG. 2*a* in the form of a basic representation.

According to one exemplary embodiment, the processing device 220 has a digital calibration filter device 210 and a control device 220. The calibration filter device is configured to receive a digital input signal $S_1$ that is based on an analog sensor output signal $S_{OUT}$ from a sensor 230 and to take a sensor-specific control signal $S_2$ as a basis for performing a digital filter processing H(z) of the digital input signal $S_1$ in order to provide a calibrated output signal $S_3$ e.g. as a calibrated sensor output signal. The control device 220 is configured to select the sensor-specific control signal $S_2$ from a plurality of control signals on the basis of an ascertained influencing parameter $S_E$ and to provide said sensor-specific control signal to the digital calibration filter device 210.

The digital calibration filter device 210 is thus configured to receive the digital input signal $S_1$ on the input side, wherein the input signal $S_1$ is based on an analog-to-digital converted analog sensor output signal $S_{OUT}$ from the sensor 230, for example. The digital calibration filter device 210 now takes the sensor-specific control signal $S_2$, which has a set SK of filter coefficients for the digital calibration filter device 210, for example, as a basis for performing the digital filter processing H(z) of the digital input signal $S_1$ in order to provide the calibrated output signal $S_3$ having an adapted frequency response. The digital calibration filter device 210 is thus programmable with the set SK of filter coefficients. The output signal $S_3$ can then be provided or perhaps also processed further or conditioned as a digital, calibrated sensor output signal having an adapted frequency response, for example.

The digital filter processing of the input signal $S_1$ is performed, by way of example, in order to obtain a prescribed (nominal) frequency response of the output signal $S_3$ within a tolerance range of e.g. 10%, 5% or 1%. The tolerance range assumed between the adapted frequency response obtained for the output signal $S_3$ and the prescribed or nominal frequency response of the output signal $S_3$ can also be, by way of example, a maximum average disparity, for example based on amplitudes of less than 1 dB, 0.5 dB, 0.2 dB, 0.1 dB or 0.05 dB in the relevant or prescribed frequency range $f_B$.

In order to obtain the digital input signal $S_1$, not only the analog-to-digital conversion of the analog sensor output signal $S_{OUT}$ but also optional conditioning, e.g. amplification and/or filtering of the analog sensor output signal $S_{OUT}$, is performed, for example.

The control device 220 is now configured to select the sensor-specific control signal $S_2$ for the digital calibration filter device 220 for different values or ranges of the external influencing variable E, e.g. for different temperature ranges $T_1$-$T_4$, from a plurality of different control signals $S_{2-1}$-$S_{2-4}$ for the digital calibration filter device 220 and to provide said sensor-specific control signal to the digital calibration filter device 210. The sensor-specific control signal $S_2$ is e.g. a prescribed set of filter coefficients SK for the digital calibration filter device 220 for the different values or ranges of the external influencing variable E. Accordingly, e.g. the plurality of different control signals $S_{2-1}$-$S_{2-4}$ is a plurality of different sets $SK_1$-$SK_4$ of filter coefficients for the digital calibration filter device 220.

The selection of the respective sensor-specific control signal $S_2$, i.e. of the respective set SK of filter coefficients, is based by way of example on an ascertained influencing parameter SE, i.e. a measured or estimated, external, physical influencing variable "E" of the sensor. One ascertained influencing parameter $S_E$ refers by way of example to an estimated or measured, external influencing variable E on the sensor that affects or influences the frequency response, i.e. amplitude response, phase response and/or group delay, of the analog sensor output sensor $S_{OUT}$ of the sensor 230 by virtue of a change in the external influencing variable E causing a change in the frequency response of the sensor output signal $S_{OUT}$ of the sensor 230. The external influencing parameter $S_E$ is thus a measured or estimated ambient parameter of the sensor 230 that, in the event of a disparity from a predetermined value during operation of the sensor 230, causes a disparity in the frequency response of the sensor output signal of the sensor 230 in comparison with a prescribed frequency response of the sensor output signal $S_{OUT}$ of the sensor 230. The ambient parameter of the sensor may be a temperature of the sensor or a temperature of the ambient atmosphere of the sensor, for example, the ambient parameter further being able to be a humidity, an air pressure or a gas concentration, e.g. a $CO_X$ concentration, in the ambient atmosphere of the sensor 230.

Whenever there is a general discussion of the influencing parameter $S_E$ as the estimated or measured, present temperature T of the sensor 230 in the description that follows, it should become clear that the explanations that follow are applicable to the same extent to further ambient parameters, such as e.g. humidity, air pressure, gas concentration, etc., in the ambient atmosphere of the sensor.

According to one exemplary embodiment, the digital calibration filter device 210 is configured to take the sensor-specific control signal $S_2$ as a basis for performing a recursive, digital filter processing of the digital input signal $S_1$.

According to one exemplary embodiment, the e.g. recursive, digital calibration filter device 210 is configured to compensate for or at least reduce an e.g. temperature-dependent disparity, caused by the external influencing variable E, in the frequency response of the digital input signal $S_1$ or of the analog sensor output signal $S_{OUT}$ in a prescribed frequency range B by means of the e.g. recursive, digital filter processing H(z).

According to one exemplary embodiment, the control device 220 is configured to take the provided information $S_E$ for the external influencing variable, E, as a basis for selecting the sensor-specific control signal $S_2$ associated with the influencing variable information and to provide said sensor-specific control signal to the digital calibration filter device 210.

According to one exemplary embodiment, the control device 220 has an optional memory 240 or is logically connected to this memory 240 if the latter is arranged externally, wherein the memory 240 stores the plurality of sensor-specific control signals $S_{2-1}$-$S_{2-4}$ in the form of the sets $SK_1$-$SK_4$ of filter coefficients. The control device 220 is further configured to take the ascertained influencing parameter $S_E$ of the sensor 230 as a basis for selecting one of the plurality of sensor-specific control signals $S_{2-1}$-$S_{2-4}$ as the sensor-specific control signal $S_2$ (for the present value of the external influencing parameter $S_E$) and to provide said sensor-specific control signal to the digital calibration filter device 210. The digital calibration filter device 210 is now programmable with the sensor-specific control signal $S_2$ provided by the control device 220. The sensor-specific control signal $S_2$ is now retained by the control device 220 in the programmable, digital calibration filter device 210 until a further, sensor-specific control signal $S_2$ is provided, e.g. based on a change in the external influencing variable $S_E$. The memory 240 stores, by way of example, a plurality of different sets $SK_1$-$SK_4$ of sensor-specific filter coefficients as the sensor-specific control signals $S_{2-1}$-$S_{2-4}$ for the digital calibration filter device 210, which are associated e.g. with different external influencing variables E or different temperatures or temperature ranges T at the sensor 230.

The control signal $S_2$ provided by the control device 220 therefore has a selected set of sensor-specific filter coefficients for the digital calibration device 210, the control device 220 being configured to select the respective set of sensor-specific filter coefficients $S_2$ on the basis of the provided influencing parameter $S_E$ of the sensor 230 and to provide the digital calibration filter device 210. The set of sensor-specific filter coefficients has two filter coefficients and preferably three filter coefficients, for example, which are provided to the digital calibration filter device and used by the latter for the digital filter process H(z).

According to one exemplary embodiment, the digital calibration filter device 210 is, by way of example, a programmable, digital, e.g. recursive filter having the transfer function H(z):

$$H(z) = \frac{b1z^1 + b0}{z^1 + a0}$$

with $b_1$, $b_0$ and $a_0$ as the set SK of filter coefficients.

According to one exemplary embodiment, the digital calibration filter device 210 is therefore a programmable, digital first-order filter, but programmable, digital higher-order filters can also be used.

According to one exemplary embodiment, the digital calibration filter device 210 is configured to take the sensor-specific control signal $S_2$ as a basis for the following recursive, digital first-order or perhaps higher-order filter processing of the digital input signal $S_1$.

According to one exemplary embodiment, the digital calibration filter device 210 is configured as a digital filter. A digital filter is e.g. a mathematical filter for manipulating a signal such as, for example, rejecting or passing a particular frequency range of the signal or perhaps changing or adapting the frequency response of the signal. Digital filters can be realized, by way of example, using logic chips such as ASICs, FPGAs or in the form of a sequential program using a signal processor. Digital filters generally process not continuous signals but rather discrete-time and discrete-value signals. A discrete-time signal in the periodic timing sequence consists only of individual pulses depicting the signal profile over time, the respective samples.

The digital calibration filter device 210 can have one or more of the digital filters or filter functions that follow, for example: a frequency-selective filter, for example a pass filter and/or a rejection filter; a decimation filter, an interpolation filter, a filter for reducing group delay. The digital calibration filter device 210 may be set up so as to be linear and time-invariant. Alternatively, the digital calibration filter device 210 has, by way of example, a filter for changing the sampling rate, for example a decimation filter and/or an interpolation filter; this means that the filter arrangement becomes nonlinear. In other words: in various exemplary embodiments, the digital calibration filter device 210 can have a filter that is set up to reduce the group delay of a signal passing through. Alternatively or additionally, the digital calibration filter device 210 can have a filter or a filter function that, for illustrative purposes, is set up as a low-pass filter or a bandpass filter. Alternatively or additionally, the digital calibration filter device 210 can have a filter or a filter function that, for illustrative purposes, alters the sampling rate of the signal, for example in the form of a decimation filter and/or an interpolation filter. The digital calibration filter device 210 can have a filter or multiple filters or filter functions. Multiple filter functions may be implemented in a common filter. The filter functions are, by way of example, changing the sampling rate of the picked-up signal, changing the frequency response of the picked-up signal, for example selectively rejecting or passing frequency ranges of the picked-up signal. The filter or the multiple filters may each be set up in single-stage or multistage fashion.

According to one exemplary embodiment, this digital filter 210 has three degrees of freedom, for example, i.e. the set of the filter coefficients SK has three coefficients $b_1$, $b_0$ and $a_0$, for example. In the event of a relatively small disparity in the influencing-variable-dependent frequency response of the sensor 230 from the prescribed or nominal frequency response for the sensor 230 and/or in the event of a reduced sampling rate, the coefficient $a_0$ in the denominator of the response function H(z) of the calibration filter device 210 can be fixed. This allows a set SK comprising two filter coefficients $b_1$, $b_2$ to suffice, for the calibration filter device 210, to bring the frequency response of the sensor output signal $S_{OUT}$ more into line, or preferably into concordance, with the prescribed frequency response. The calibrated output signal $S_3$ is different than the input signal $S_1$ at least in one frequency range (cf. LFRO). In one exemplary embodiment, the calibrated output signal in at least one further frequency range, which is different than the prescribed frequency range B, is further consistent with the input signal $S_1$, i.e. for example in a frequency range for frequencies from 1 kHz to 10 kHz of the sensor output signal.

According to one exemplary embodiment, the set of filter coefficients SK for the digital calibration filter device 210 can also have more than three coefficients, for example.

Figure 1B:
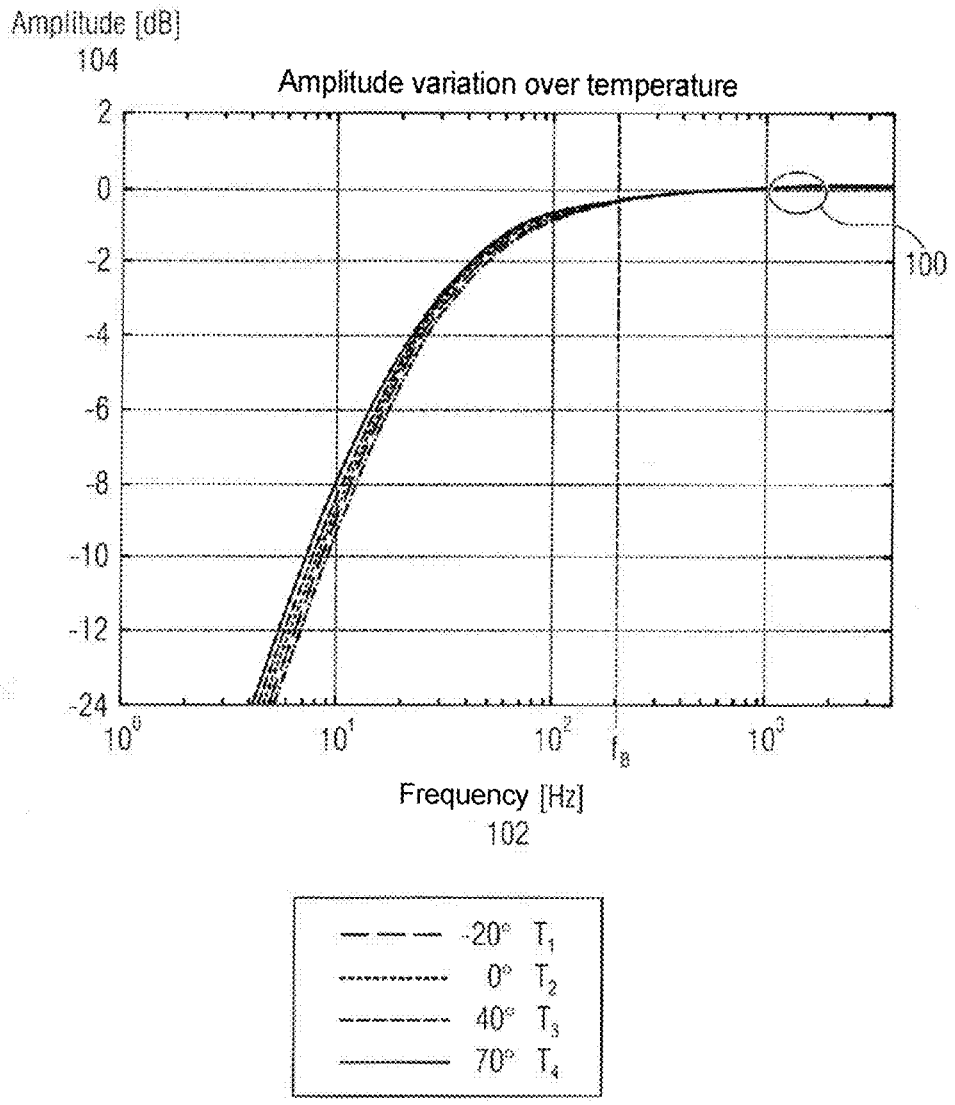
FIG. 1*b* shows an enlarged depiction of the exemplary amplitude response over temperature for low frequencies (LFRO) of a sensor output signal without compensation for the frequency response.
Figure 2A:
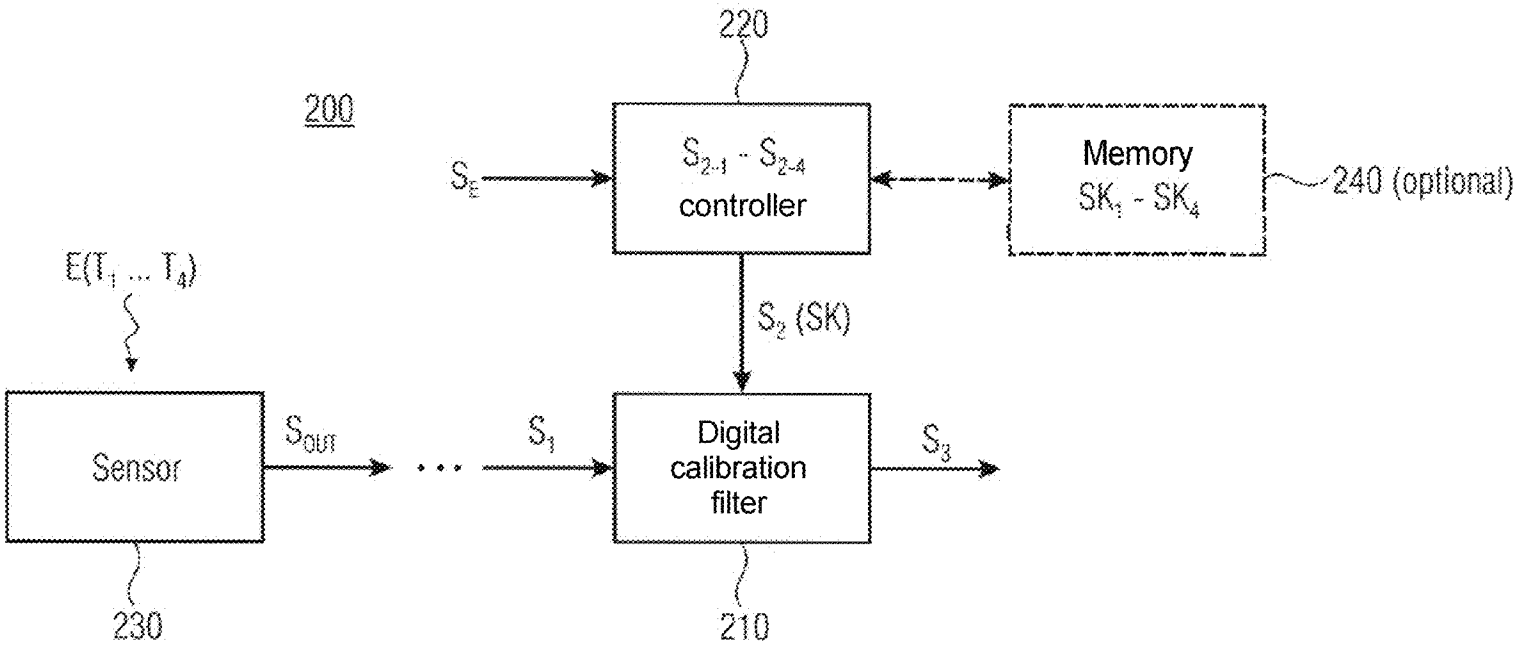
FIG. 2*a* shows a basic block diagram of a processing device for calibrating a sensor output signal according to an exemplary embodiment.
Figure 2B:
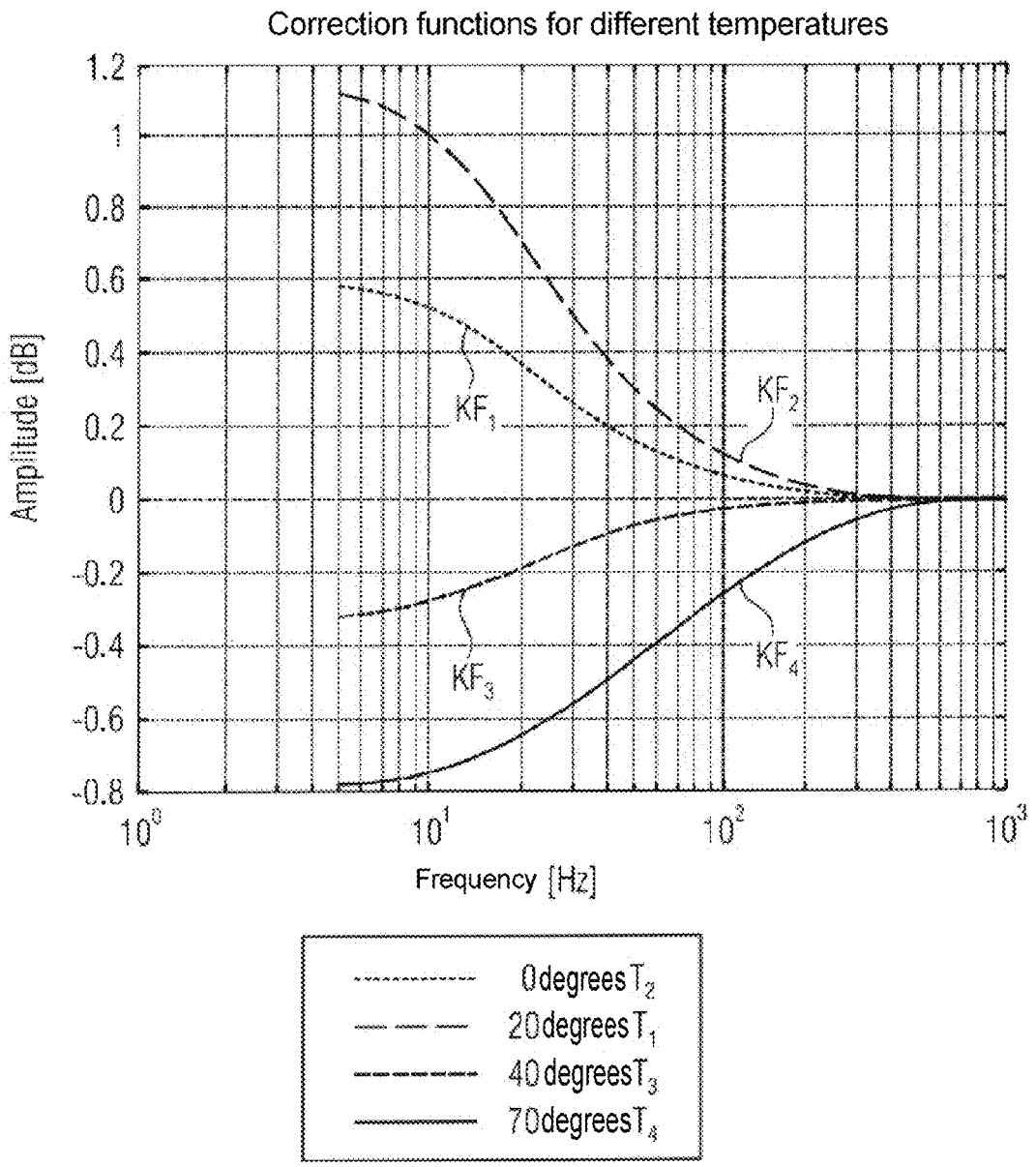
FIG. 2*b* shows exemplary depictions of correction functions for different values or value ranges of the external influencing variable, e.g. temperature, according to an exemplary embodiment.

FIG. 2*b* now specifies exemplary correction functions for different values of the external influencing variable E, e.g. the temperature, for the frequency response (in this case amplitude response) according to one exemplary embodiment. The frequency response to be compensated for can be assumed to be the uncalibrated amplitude response, specified in FIGS. 1*a*-1*b*, of a sensor output signal, for example.

As depicted in FIG. 2*b*, four correction functions are specified for four different temperatures or temperature ranges $T_1$=0° C., $T_2$=20° C., $T_3$=40° C. and $T_4$=70° C., for example. By way of example, what is known as a "backend test" involves the different filter coefficients SK for the programmable, digital calibration filter device 210 being ascertained and being stored as different sets $SK_1$-$SK_4$ of filter coefficients in the memory 240.

FIG. 2*b* now depicts the necessary corrections or correction functions $KF_1$-$KF_4$ for the different values or ranges $T_1$-$T_4$ of the external influencing variable E for the amplitude response of the sensor output signal $S_{OUT}$ by way of example. These correction functions $KF_1$-$KF_4$ for the amplitude response of different temperatures $T_1$-$T_4$ are simulated by means of the digital filter 210 with the applicable sets $SK_1$-$SK_4$ of coefficients $b_1$, $b_0$, $a_0$ using optimization methods.

A first set $SK_1$ of filter coefficients therefore corresponds to the correction function $KF_1$, a second set $SK_2$ of filter coefficients therefore corresponds to the correction function $KF_2$, a third set $SK_3$ of filter coefficients corresponds to the correction function $KF_3$, and a fourth set $SK_4$ of filter coefficients corresponds to the correction function $KF_4$ or simulates this correction function for the digital filter processing of the input signal $S_1$.

Based on the sets $SK_1$-$SK_4$ of filter coefficients $b_1$, $b_0$, $a_0$ described by way of example, the digital filter process of the calibration filter device 210 can be used to perform the correction or adaptation of the amplitude response of the analog sensor output signal $S_{OUT}$ or of the digital input signal $S_1$ derived therefrom for different values or ranges of the external influencing variable.

Figure 2C:
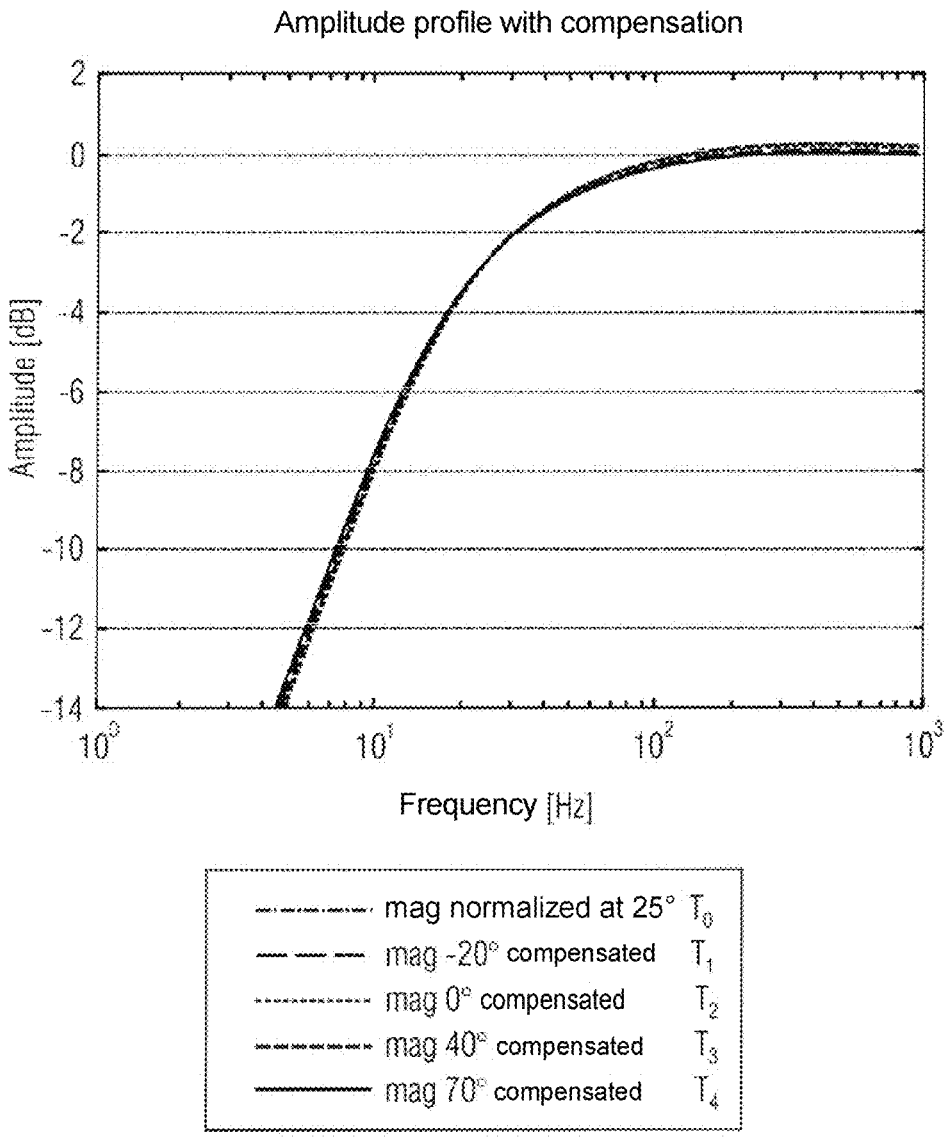
FIG. 2*c* shows an exemplary depiction of a resultant, calibrated amplitude response of a sensor output signal according to an exemplary embodiment.

FIG. 2*c* is now an exemplary depiction of a resultant, "calibrated" amplitude response of the calibrated output signal $S_3$ according to an exemplary embodiment. As is evident from FIG. 2*c*, the present digital filter processing H(z) of the digital input signal $S_1$ can be used to obtain substantially concordant amplitude responses for different values of the external influencing variable, e.g. for different temperatures of the sensor 230, within the tolerance range.

According to one exemplary embodiment, the prescribed frequency response of the sensor output signal $S_{OUT}$ or of the digital input signal $S_1$ is a prescribed amplitude response, a prescribed phase response and/or a prescribed group delay in a prescribed frequency range B.

According to one exemplary embodiment, the sensor 230 can have multiple sensor elements (not shown in FIG. 1) that each provide an analog sensor output signal $S_{OUT}$, wherein the frequency response of at least one sensor output signal from one of the sensors has the prescribed frequency response altered in the event of a change in the external influencing parameter.

According to one exemplary embodiment, the sensor has an MEMS component, such as e.g. an MEMS sound transducer or an MEMS microphone, wherein the MEMS component is configured to provide the analog sensor output signal $S_{OUT}$.

According to the exemplary embodiments depicted, a programmable, digital calibration filter is employed in order to compensate for a frequency variation, dependent on an external influencing variable, in the sensor output signal from a sensor, such as e.g. an MEMS sensor, an MEMS sound transducer or MEMS microphone. The external influencing variable can be regarded as a temperature of the sensor itself or a temperature of the ambient atmosphere of the sensor, or perhaps a present humidity, a present air pressure or a present gas concentration in the ambient atmosphere of the sensor.

The exemplary embodiments described discuss e.g. a temperature-dependent frequency response variation in the sensor output signal $S_{OUT}$, the explanations being applicable to the same extent to the further ambient parameters in the ambient atmosphere of the sensor, such as e.g. humidity, air pressure, gas concentration, etc.

According to the present design, a set of filter coefficients (also control signal) for the calibration filter is stored e.g. in a memory on the sensor or else in an external memory, with different sets of coefficients being stored in the memory depending on different ranges of the external influencing variable, e.g. depending on different temperature ranges, etc. The sets of coefficients are now configured or are calculated to simulate the digital filter function of the calibration filter on the actual frequency response, such as e.g. amplitude response, phase response and/or group delay, of the sensor output signal for different influencing variables or different ranges of the external influencing variable, i.e. for different temperatures or different temperature ranges, for example. The different sets of coefficients are thus stored in the memory as a function for the external influencing variable, such as e.g. the temperature, for the sensor. After the sensor, e.g. the MEMS sound transducer, is installed or accommodated in the package, the filter coefficients are determined for the finished component, for example, and stored in the memory.

This ascertainment of the filter coefficients can actually also be performed at wafer level, for example, insofar as there are mathematical models in place for accommodating the sensor in a package, for example, i.e. insofar as the accommodation of the sensor in a package can be subsequently modeled or reconstructed. The influencing-variable-dependent (e.g. temperature-dependent, etc.) filter coefficients obtained are then stored e.g. in a sensor-internal memory in each sensor or in an external memory for each sensor.

Depending on the models available for the accommodation in a package, it is also conceivable for, by way of example, just two values of the external influencing variable, e.g. two temperature points, to result in the actual behavior of the finished sensor device being compared with the model and, in the event of sufficiently precise concordance, the model, i.e. the dependency of the filter coefficients on the external influencing variable (e.g. the temperature, etc.) to be stored in the associated memory. In the case of the present design, it is assumed, by way of example that the package, i.e. the whole sensor device, is at an identical temperature if the sensor temperature is the external influencing variable.

The filter coefficients or sets of filter coefficients ascertained in a backend test, for example, are stored in a memory associated with the sensor, the analog sensor output signal obtained from the sensor being supplied, after digitization thereof, to the additional, programmable, digital calibration filter and subjected to the appropriate digital filtering in order to perform compensation for or calibration of the frequency response variation that is dependent on the external influencing variable, e.g. temperature-dependent.

The digital, e.g. recursive, calibration filtering can also be moved ("to the rear") in the signal path, i.e. the digital calibration filtering can e.g. also be performed in the digital program code (CODEC) of a data processing device, e.g. a microprocessor, of a device or mobile device in which the sensor is installed, for example. Further, an interface on the sensor is conceivable in order to allow the sets of filter coefficients stored in the memory of the sensor to be written or read.

The values for the external influencing variable, e.g. the temperature values, etc., can be provided, by way of example, by means of a dedicated sensor for the external influencing variable, e.g. by means of a dedicated temperature sensor, on the sensor, e.g. the MEMS component.

Alternatively, it is possible to estimate temperature information or to use the temperature of the (mobile) device in which the sensor is installed.

A few possible scenarios for the exemplary embodiment in which the set of filter coefficients dependent on the external influencing variable is stored in a memory on the sensor (MEMS component) are depicted below.

If the influencing variable sensor, according to a first option, is arranged on the MEMS component (sensor), the programmable calibration filter may also be on the MEMS component in order to perform the digital filter processing on a digitized version of the analog sensor output signal.

If the influencing variable sensor, e.g. temperature sensor, according to a further option, is in the e.g. mobile device or smartphone and not in the MEMS component, the influencing-variable-dependent calibration filtering can take place, by way of example, in the CODEC of the device in which the MEMS component is installed as a sensor.

If an interface for data interchange is provided on the sensor, a data interchange can be performed between the (mobile) device and the sensor, which means that, according to this third option, it is either possible for the digital calibration filtering to be effected in the sensor, i.e. the processing device therein, for example if information about the external influencing variable, e.g. temperature information, is provided to the sensor by the (mobile) device, or, according to the above second option, for the sets of filter coefficients to be transmitted from the sensor to the (mobile) device on demand in order to perform the digital calibration filtering in the CODEC of the (mobile) device.

A common feature of the different exemplary embodiments depicted above is that the digital calibration filter is dynamically adapted using the respective filter coefficients associated with the external influencing variable, i.e. is programmed with said filter coefficients, based on the measured or estimated external influencing variable, i.e. on the basis of the measured or estimated temperature or on the basis of different temperature ranges. The programmable calibration filter now retains the provided and programmed set of filter coefficients until, on the basis of changed values of the external influencing variable, a new or updated set of filter coefficients is provided to the calibration filter, i.e. the calibration filter is programmed with the new set of filter coefficients.

The digital calibration filter, which can also be referred to as an equalizer, for example, can therefore perform optimization or calibration both of the amplitude response or the phase response and of the group delay of the sensor output signal from the sensor.

Figure 3:
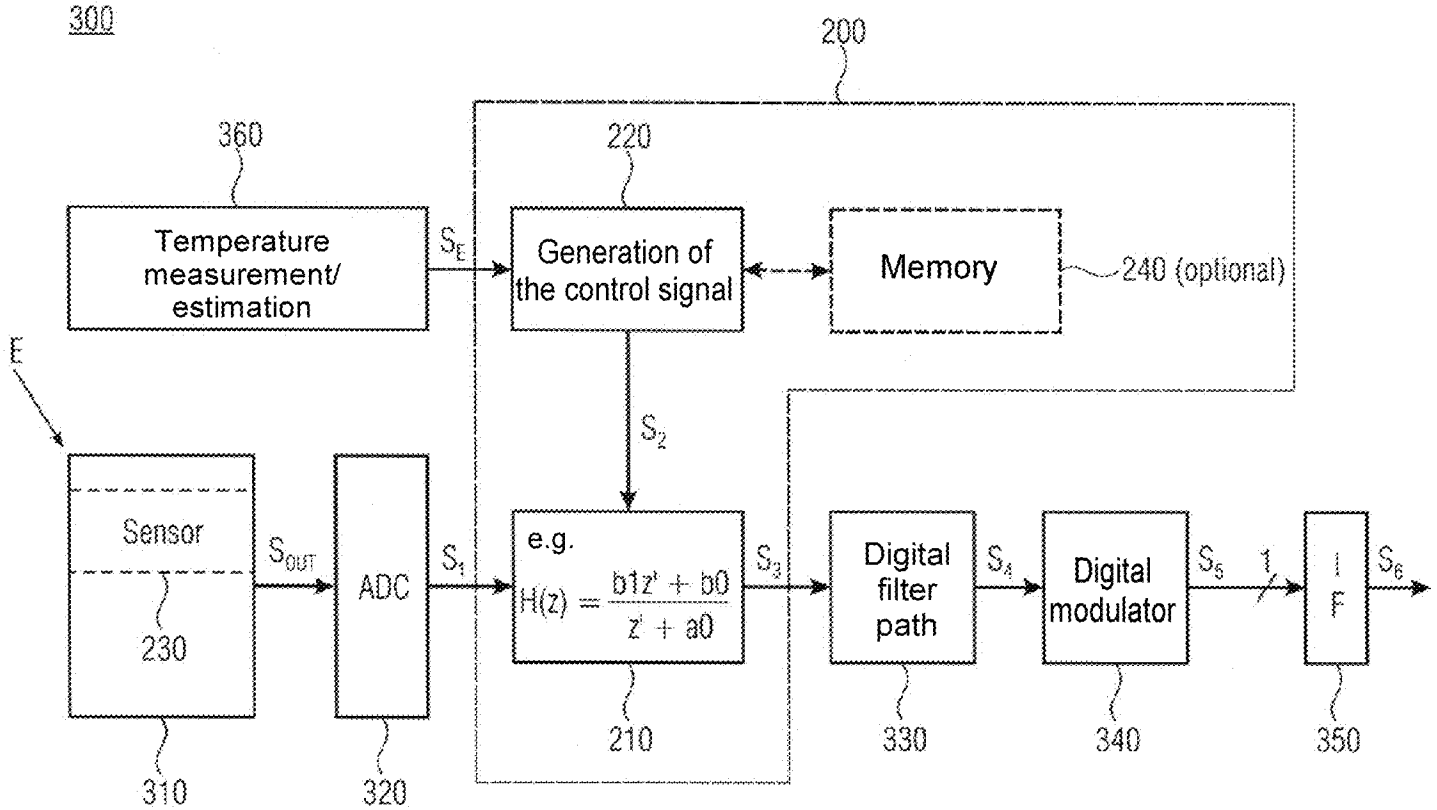
FIG. 3 shows an exemplary basic representation of a block diagram of a switching circuit arrangement with the processing device for calibrating a sensor output signal according to an exemplary embodiment.

FIG. 3 now depicts a basic representation of a block diagram of a circuit arrangement using the processing device 200 depicted in FIG. 2*a* according to an exemplary embodiment in the form of a digital filter path with optimized LFRO. The processing device 200 having the programmable calibration filter device 210 and the control device 220 is now part of the circuit arrangement 300 according to an exemplary embodiment.

According to one exemplary embodiment, the circuit arrangement 300 has a sensor arrangement 310 having at least one sensor 230, an analog-to-digital converter 320, the processing device 200, a filter arrangement 330, a modulator 340, an interface 350 and an influencing variable sensor device 360 that has e.g. a temperature sensor.

The calibration filter device 210 is set up in programmable fashion, so that the frequency response of the sensor output signal $S_{OUT}$ from the sensor 230 or from the sensors 230 of the sensor arrangement 310, in each case in a prescribed frequency range B, can correspond or substantially (within a tolerance range) correspond to a prescribed or nominal frequency response for this sensor arrangement 310. The sensor arrangement 310 can be calibrated for specific sensors, for individual sensors or for the group of sensors 230 with similar properties. The error in the sensor arrangement or the disparity from the prescribed frequency response on the basis of the external influencing variable E, such as e.g. the temperature T of the sensor or the temperature T of the ambient atmosphere of the sensor, or perhaps the humidity, air pressure or a gas concentration ($CO_2$, etc.) in the ambient atmosphere of the sensor 230, can be measured or estimated using the influencing variable sensor device 360, an applicable signal $S_E$ being able to be ascertained for the measured or estimated, external influencing parameter. On the basis thereof, a set of filter coefficients can be selected from two or more sets of filter coefficients (also referred to as a control signal) for the calibration filter device 210, and the calibration filter device 210 can be programmed accordingly. The selection is made such that the calibrated signal, in a prescribed frequency range B, for example in a range from 10 Hz to 200 Hz, has a frequency response (amplitude response, phase response and/or group delay) that, on average, has the smallest possible disparity from a prescribed frequency response for the sensor arrangement, for example in a region of less than ±5%, ±2%, ±1% around the respective value of the frequency response. The error signal used can be the amplitude error, phase error or group delay error, for example.

For illustrative purposes, the circuit arrangement 300 having the processing device 200 allows the frequency response of the sensor output signal $S_{OUT}$ from the sensor 230 or from the sensor arrangement 310 to be optimized based on the respective sensor-specific control signal $S_2$. This allows fluctuations in the frequency response of the sensor output signal from the sensors that are caused by external influencing variables, for example in the low-frequency signal range B (LFRO), to be compensated for, this also being able to be understood as optimization of the frequency response, for example.

The circuit arrangement 300 is configured, by way of example, as a pressure sensor arrangement or a sound transducer arrangement, e.g. microphone arrangement, using an MEMS component. The microphone arrangement 310 can have an arrangement having one or more microphones (MEMS microphones). In this case, the microphones are set up as sensors 230 of the sensor arrangement 310.

In exemplary embodiments, the circuit arrangement 300 is used to record, by way of example, ambient sound, speech, music or the like in the form of sound pressure changes and provide an output signal $S_6$ based thereon. The recording or provision of a signal can be understood as providing an electrical signal that is dependent on the ambient sound or on the sound pressure acting on the microphone. In particular, various microphone types can be used, the sensor 230 being implemented, according to one exemplary embodiment, as an MEMS (microelectromechanical system) sound transducer or MEMS microphone or as an MEMS silicon microphone.

Correspondence or substantial (within a tolerance range) correspondence of the frequency response of the sensor output signal $S_{OUT}$ to a prescribed frequency response means that the amplitude gain, the phase angle and/or the group delay of the sensor output signal $S_{OUT}$ from the sensor at a frequency corresponds to the prescribed value of the frequency response at this frequency, i.e. is identical (for example with due regard to rounding rules and measurement errors), or is within a tolerance range around this value, i.e. the respective value of the signal may differ slightly from the value of the prescribed frequency response. By way of example, the value of the signal corresponds substantially to the prescribed value of the prescribed frequency response if it is in a region of, by way of example, approximately ±10%, for example ±5% or ±1%, around the value of the prescribed frequency response.

If the signal $S_1$ picked up by a filter is based on another, provided signal $S_{OUT}$, this is intended to be understood to mean that the picked-up signal $S_1$ is identical to the provided signal $S_{OUT}$ or that the provided signal is first of all also processed elsewhere, for example by another filter, before it is picked up by the filter.

The at least one sensor 230 is set up to provide an analog signal $S_{OUT}$. The sensor arrangement 310 can have multiple sensors 230. The sensors 230 each provide an analog signal $S_{OUT}$. At least one signal $S_{OUT}$ from a sensor 230 has the prescribed frequency response altered. Additionally, the signals $S_{OUT}$ from multiple sensors 230 of the sensor arrangement 310 can have a common, prescribed frequency response, i.e. the same frequency response, altered.

At least one sensor 230 of the sensor arrangement can have a diaphragm, with a deflection of the diaphragm from a position of rest generating the analog signal $S_{OUT}$. The diaphragm is a microelectromechanical structure (MEMS), for example, or has such a structure. Alternatively or in other words, the sensor may be or have a microelectromechanical structure.

The analog-to-digital converter 320 is set up to receive the analog signal $S_{OUT}$ and provide a first signal $S_1$. Optionally, the analog signal $S_{OUT}$ from the sensor can be amplified by means of an amplifier, for example a source follower, before being picked up by the analog-to-digital converter 320. The analog-to-digital converter 320 may be a multi-bit converter, which means that the first signal $S_1$ is a multi-bit representation. The analog-to-digital converter is a, for example 3rd-order, sigma-delta analog-to-digital converter, for example.

The sampling frequency of the analog-to-digital converter 320 may be variable, which means multiple sampling frequencies can be supported by the circuit arrangement 300. According to a few embodiments of circuit arrangements serving as an example, a property of the sensor arrangement is variable, which can allow similar modification properties of the sensor arrangement to be achieved for different sampling frequencies of the analog-to-digital converter 320. The sampling frequency has a value in a range from approximately 1 MHz to approximately 4 MHz, for example.

The control unit 220 is set up to select a sensor-specific control signal $S_2$, which is dependent on the frequency response of the sensor 230, for multiple control signals $S_{2-1}$-$S_{2-4}$ and to provide said sensor-specific control signal to the calibration filter 210.

The control unit 220 is an integrated circuit (IC) or an application-specific integrated circuit (ASIC), for example, or has such a circuit. It can further have or be connected to a detector circuit in order to detect a sensor-specific property of a sensor 230 connected to the control unit 220.

The calibration filter 210 is set up to receive a signal based on the first signal $S_1$ and to provide a calibrated signal $S_3$. The calibrated signal $S_3$ output by the calibration filter 210 is further dependent on the control signal $S_2$, which is based on a property $S_E$ detected on a sensor-specific basis.

The calibration filter 210 operates in the discrete-time digital domain and, in each processing step, provides a signal $S_3$ having a calibrated prescribed frequency response. The calibrated signal is dependent on the present input signal multiplied by scaling parameters ($a_0$, $b_0$, $b_1$). The input signal may be or may be based on the first signal $S_1$ provided by the analog-to-digital converter 320.

The calibration filter 210 may be set up as a programmable, digital calibration filter 210. Alternatively or additionally, the calibration filter 210 is set up as a digital calibration filter 210. By way of example, the calibration filter 210 has at least two filter coefficients $b_0$, $b_1$, for example three filter coefficients $a_0$, $b_0$, $b_1$.

The calibration filter is, by way of example, a programmable digital, e.g. recursive filter having the transfer function H(z):

$$H(z) = \frac{b1z^1 + b0}{z^1 + a0}$$

with $b_1$, $b_0$ and $a_0$ as filter coefficients.

This filter fundamentally has three degrees of freedom, i.e. three coefficients. In the event of a small disparity in the frequency response from the prescribed frequency response and/or in the event of a reduced sampling rate, the coefficient $a_0$ in the denominator of the response function H(z) of the calibration filter can be fixed. This allows two filter coefficients ($b_1$, $b_0$) to suffice, for the calibration filter, to bring the frequency response of the circuit arrangement more into line, or into concordance, with the prescribed frequency response.

The calibrated signal $S_3$ is different than the first signal $S_1$ in at least one frequency range. In various exemplary embodiments, the calibrated signal $S_3$ in at least one frequency range is consistent with the first signal $S_1$, for example for frequencies greater than approximately 10 kHz. In other words, i.e. in this frequency range, the calibration filter 208 effects a 1-to-1 mapping of the signal, as illustrated in FIG. 3A.

The filter arrangement 330 is set up to receive a signal $S_3$ based on the first signal $S_1$ and to provide a further signal $S_4$. For illustrative purposes, the filter arrangement 330 is connected to the analog-to-digital converter 320, so that the signal $S_1$ provided by the analog-to-digital converter 320 is processed to produce, or converted into, a signal $S_4$ provided by the filter arrangement 330. By way of example, the filter arrangement 330 is set up to receive a signal based on the calibrated signal $S_3$, for example the calibrated signal $S_3$, and to provide a further signal $S_4$.

The further signal $S_4$ is different than the calibrated signal and the first signal in at least one frequency range. In various exemplary embodiments, the further signal $S_4$ corresponds in at least one frequency range to the calibrated signal $S_3$, i.e. a 1-to-1 mapping of the signal in this frequency range is effected by the filter arrangement or the calibration filter.

The filter arrangement 330 can have one or more of the filters or filter functions that follow, for example: a frequency-selective filter, for example a pass filter and/or a rejection filter; a decimation filter, an interpolation filter, a filter for reducing group delay. The filter arrangement 330 may be set up so as to be linear and time-invariant. Alternatively, the filter arrangement 330 has, by way of example, a filter for changing the sampling rate, for example a decimation filter and/or an interpolation filter; this means that the filter arrangement becomes nonlinear. In other words: in various exemplary embodiments, the filter arrangement can have a filter that is set up to reduce the group delay of a signal passing through. Alternatively or additionally, the filter arrangement 330 can have a filter or a filter function that, for illustrative purposes, is set up as a low-pass filter or a bandpass filter. Alternatively or additionally, the filter arrangement 330 can have a filter or a filter function that, for illustrative purposes, changes the sampling rate of the signal, for example in the form of a decimation filter and/or an interpolation filter. The filter arrangement can have a filter or multiple filters or filter functions. Multiple filter functions may be implemented in a common filter. The filter functions are, by way of example, changing the sampling rate of the picked-up signal, changing the frequency response of the picked-up signal, for example selectively rejecting or passing frequency ranges of the picked-up signal. The filter or the multiple filters may each be set up in single-stage or multistage fashion.

The picked-up and provided signals $S_1$, $S_2$, $S_3$, $S_4$, $S_5$, $S_6$, $S_E$ described in even more detail below may each be a digital signal and different than one another.

The calibrated signal $S_3$ provided by the calibration filter 210 is based on the first signal $S_1$ provided by the analog-to-digital converter 320 and on the sensor-specific control signal $S_2$ provided by the control unit 220. The calibrated signal $S_3$ corresponds or substantially corresponds, in a prescribed frequency range, to a prescribed frequency response.

The sensor-specific control signal $S_2$ may be dependent on a measured or estimated property of the sensor $S_E$ in terms of a prescribed amplitude response, a prescribed phase response and/or a prescribed group delay. The control unit 220 has a memory 240 for example, or is connected to a memory. The memory stores the multiple control signals $S_{2\text{-}1}$-$S_{2\text{-}4}$. The control unit 220 is set up to take the measured or estimated property of the sensor SE as a basis for selecting one of the multiple control signals $S_2$ as the sensor-specific control signal $S_2$ and to provide said control signal to the calibration filter 210.

The sensor-specific control signal $S_2$ can contain a set SK of filter coefficients or filter coefficients for the calibration filter. Alternatively or additionally, the calibration filter 210 can have or be connected to a further memory. This further memory can store multiple sets of filter coefficients or filter coefficients for the calibration filter 210. The calibration filter 210 is set up to take the sensor-specific control signal as a basis for loading a set of filter coefficients from the memory connected to the calibration filter. This allows the signal based on the first signal and picked up by the calibration filter to be altered toward or calibrated to the prescribed frequency response.

The first signal $S_1$, provided by the analog-to-digital converter 320, can have the same sampling rate as the signal $S_6$ provided by the sensor arrangement or circuit arrangement 300 when the behavior of the circuit arrangement is linear and time-invariant. However, the two signals can differ in amplitude, phase and group delay.

The ratio of the amplitudes of the picked-up signal (input signal) and the provided signal (output signal) as a function of frequency is the amplitude response. The difference in phase between the input signal and the output signal as a function of frequency is the phase response.

The circuit arrangement 300 can, in various exemplary embodiments, further have a modulator 340. The modulator is connected to the analog-to-digital converter 320, the calibration filter 210 and/or the filter arrangement 330. The modulator 340 is set up to provide a signal $S_5$ based on the calibrated signal $S_3$. The signal $S_5$ can be based on the further signal $S_4$, for example, i.e. the modulator 340 is set up to receive a signal based on the signal $S_4$ and to provide a signal $S_5$.

The signal picked up by the modulator 340 has a first word length. The modulator 340 is set up to process the signal picked up by the modulator 340 such that the signal $S_4$ provided by the modulator 340 has a second word length. The second word length may be shorter than the first word length, for example the first word length is greater than 4 bits, for example greater than 8 bits, for example greater than 20 bits; and the second word length is less than 8 bits, for example less than 4 bits, for example 1 bit.

A few embodiments serving as an example provide a signal $S_5$, $S_6$ in a single-bit representation and can provide this signal by means of the modulator 340 to provide the single-bit representation from a multi-bit representation that can be used in preceding processing steps within the sensor arrangement.

The circuit arrangement 300 can further have an interface 350. The interface 350 is set up to provide an output signal $S_6$. The signal $S_6$ is based on the second signal $S_4$ or the calibrated signal $S_3$. By way of example, the interface 350 may be set up to receive the signal $S_5$, and may be set up to provide the signal $S_6$. The signal $S_6$ may be identical to the calibrated signal $S_3$, or the signals $S_4$, $S_5$.

The interface 350 is set up to provide the signal $S_6$ to surroundings external to the circuit arrangement and can have a female connector, for example. By way of example, the interface 350 may be set up to split the signal to be output over multiple channels or pins. The signal $S_6$ provided by the interface 350 can be provided in any different representations. By way of example, a single-bit protocol can be used, which means that the signal $S_6$ is provided as a bit stream. Other implementations can provide the signal $S_6$ as a sequence of bits or bytes, for example in the hexadecimal system or the decimal system. Further embodiments can provide a signal $S_6$ as an analog signal. The interface 350 can have, by way of example, an audible output device and/or a visual output device connected to it, for example a loudspeaker or a visual display unit. The output device can have further filters and/or signal-processing components that process the signal provided on the interface further and alter it. The signal $S_6$ may be a single-bit signal or a multi-bit signal (also referred to as an m-bit or multi-bit signal).

In other words: in the exemplary embodiment illustrated in FIG. 3, the sensor 230 of the sensor arrangement provides the analog signal $S_{OUT}$. The analog-to-digital converter 320 picks up the analog signal $S_{OUT}$ and provides a first signal $S_1$. The filter arrangement 210 picks up a signal based on the first signal $S_1$ and provides the signal $S_3$. The modulator 34 picks up a signal based on the signal $S_4$ and provides the signal $S_5$.

A circuit arrangement according to a few embodiments serving as an example further comprises one or more connections in order to provide the option of connecting all the components within the sensor arrangement to further circuit arrangements, printed circuit boards or the like in a single assembly step by means of the connection (the connections).

A few embodiments of a circuit arrangement that serve as an example comprise a common package arrangement at least partially enclosing the sensor and the further components, for example the amplifier, for example source follower, the analog-to-digital converter 320, the filter arrangement 330 and/or the modulator 340, wherein the common package arrangement has supply connectors for electrically connecting all the components to further circuit arrangements. A circuit arrangement according to a few embodiments serving as an example can be understood as a single unit that can be treated as a discrete independent apparatus, which means that the components within the circuit arrangements can be connected to further apparatuses or circuit arrangements by virtue of the circuit arrangement as a whole being electrically connected to the further circuit arrangements. This can allow the number of connections used within an application to be reduced, for example by virtue of a single supply voltage connection being used for the sensor and the further components within the package.

The circuit arrangement 300 can have a digital microphone or an analog microphone, for example. The microphone can have a loudspeaker and/or a voice recognition apparatus arranged downstream of it, for example, which loudspeaker and/or voice recognition apparatus may be part of the circuit arrangement or is/are connectable thereto by means of an interface. In other words: the sensor 230, the analog-to-digital converter 320, the respective filters 210, 330, the control unit 220 and/or the optional modulator 340 may be implemented in one or more apparatuses that can be connected to one another.

In various exemplary embodiments, the filter arrangement 330 can receive the signal $S_1$ provided by the analog-to-digital converter 320 and can provide the signal $S_4$, which is picked up by the calibration filter 210 and—as described above—has a prescribed frequency response calibrated. The filter arrangement 330 can in this case alter, for example reduce, the sampling rate of the first signal $S_1$. In this case, the circuit arrangement is nonlinear and not time-invariant. Therefore, the filter coefficients differ from those when the filter arrangement 330 is arranged downstream of the calibration filter. For illustrative purposes, the fact that the filter arrangement 330 is arranged upstream of the calibration filter 210 in terms of signal flow means that the signal altered by the filter arrangement 330 is recalibrated. When the sampling rate of the first signal $S_1$ is reduced by the filter arrangement 330, the calibration of the signal $S_6$ provided at the interface 350 to the prescribed frequency response by the calibration filter can become more efficient or simpler.

The text below now uses the basic representation depicted in FIG. 4 to explain an e.g. mobile, electronic device 400, such as e.g. a smartphone, notebook, tablet, laptop, a smartwatch, etc., with the processing device 200 and optionally the circuit device 300 (as described above) according to an exemplary embodiment.

Figure 4:
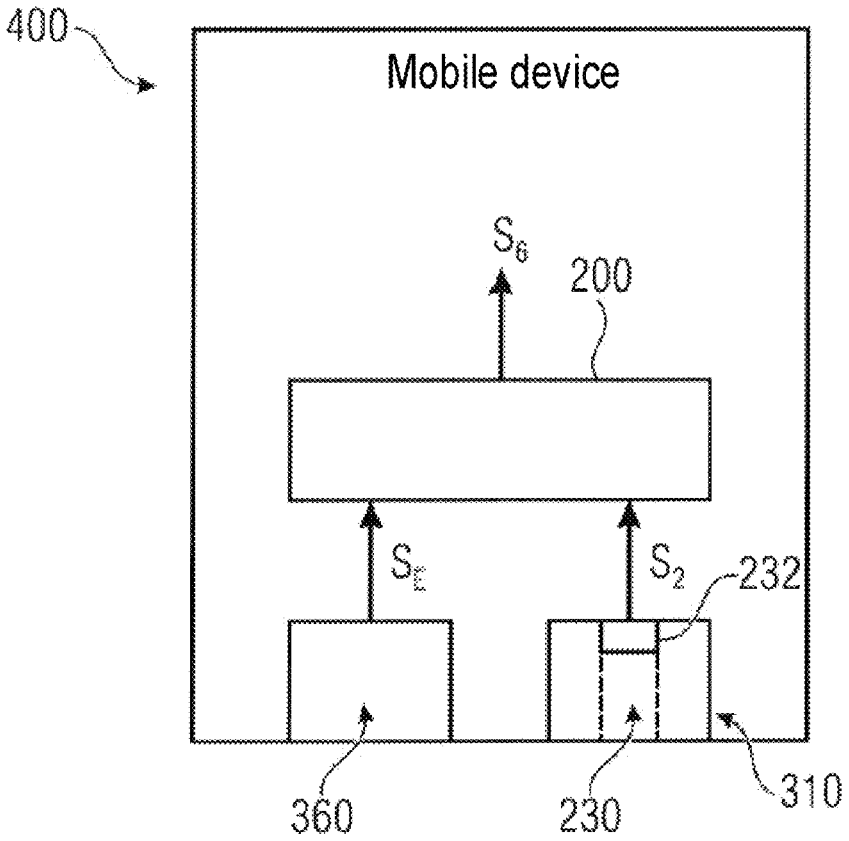
FIG. 4 shows an exemplary basic representation of a mobile device with the processing device according to an exemplary embodiment.

As depicted in FIG. 4, the mobile device 400 has the processing device 200 and/or optionally the circuit arrangement 300 according to the exemplary embodiments described previously. Further, the mobile device 400 has an influencing variable sensor device 360 for providing the ascertained influencing parameter $S_E$ of the sensor 230 to the processing device 200 or to the control device 210 of the processing device.

According to one exemplary embodiment, the processing device 200 may be implemented in the sensor arrangement 310, which means that the digital calibration filter device 210 for digital filter processing of the sensor output signal $S_{OUT}$ can be implemented in the sensor arrangement 310.

According to one exemplary embodiment, the sensor arrangement 310 can have an interface 232 in order to perform an exchange of information with the processing device 200 in order to provide the sensor-specific control signal $S_2$, i.e. the respective set SK of filter coefficients, from a memory 240 of the processing device 200 to the sensor device 310, the memory 240 being associated with the processing device 200 or logically connected to the processing device 200.

According to one exemplary embodiment, the processing device 200 can further have a digital program code (CODEC) for data processing, the digital calibration filter device 210 being able to be implemented at least partially or perhaps fully in the program code of the processing device 200 of the mobile device 400.

Further, the influencing variable sensor device 360 can have a temperature sensor device that is thermally coupled to the sensor 230 in order to determine or at least estimate a temperature signal $S_E$ for the temperature T present at the sensor 230 or in the ambient atmosphere of the sensor 230 in order to take the measured or estimated external influencing parameter E, i.e. the temperature T, for example, as a basis for providing a corresponding information signal $S_E$ to the processing device.

The digital calibration filtering can also be moved "to the rear" in the signal path, i.e. the digital calibration filtering can e.g. also be carried out in the digital program code (CODEC) of the data processing device 200, e.g. a microprocessor, of the mobile device 400 in which the sensor 230 is installed, for example.

Figure 5:
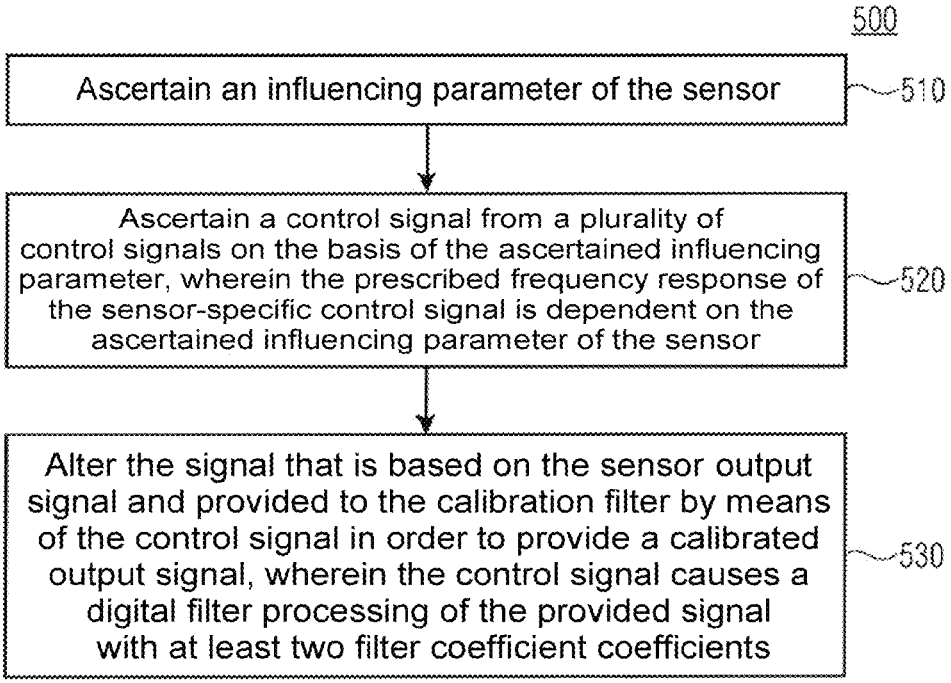
FIG. 5 shows a basic representation of the method steps for a method for calibrating a sensor output signal from a sensor according to an exemplary embodiment.

The text below now uses FIG. 5 to describe the basic flow of the method steps of an exemplary method for calibrating a sensor output signal from a sensor in a circuit arrangement according to an exemplary embodiment.

By way of example, the circuit arrangement 300 has a sensor arrangement having at least one sensor 230 configured to provide an analog sensor output signal $S_{OUT}$. A method 500 for calibration first of all involves a measured or estimated, external influencing parameter of the sensor 230 of the sensor arrangement 310 being captured in a step 510.

A step 510 involves an influencing parameter of the sensor being ascertained.

A step 520 involves a control signal from a plurality of control signals being ascertained on the basis of the ascertained influencing parameter, the prescribed frequency response of the sensor-specific control signal being dependent on the ascertained influencing parameter of the sensor.

A step 530 involves the signal that is based on the sensor output signal and provided to the calibration filter being altered by means of the control signal in order to provide a calibrated output signal, the control signal causing a digital filter processing of the provided signal with at least two filter coefficient coefficients.

According to one exemplary embodiment, the step of alteration 530 involves a recursive, digital filter processing of the provided signal with at least two filter coefficient coefficients being caused, for example.

According to one exemplary embodiment, the capture of the influencing parameter results in, by way of example, a measured or estimated, present, external influencing variable of the sensor being captured that, in the event of a disparity from a predetermined value during operation of the sensor, causes a disparity in the frequency response of the sensor in a prescribed frequency range in relation to the prescribed frequency response of the sensor.

According to one exemplary embodiment, a plurality of different sets of sensor-specific filter coefficients for the digital filter processing are stored in a memory, wherein the different sets are associated with different values of the influencing parameter, e.g. temperatures or temperature ranges, of the sensor.

According to one exemplary embodiment, a set of sensor-specific filter coefficients for the digital filter processing is selected and provided on the basis of the measured or estimated influencing parameter of the sensor of one of the plurality of control signals.

The text below refers to FIGS. 2 to 5 above to depict the present design for calibrating the frequency response of a sensor output signal once more in summary.

In order to compensate for the e.g. temperature-dependent variation in the LFRO (Low Frequency Roll-off) in the sensor output signal $S_{OUT}$ from a sensor 230, e.g. an MEMS sound transducer, exemplary embodiments involve a programmable digital filter (calibration filter) 210, as depicted in FIGS. 2*a* and 3, being used. According to a measured and/or estimated temperature or a measured and/or estimated, external influencing variable E, the coefficients of a digital filter, i.e. the digital calibration filter device 210, are set. Investigations by the inventors have shown that in general a first-order digital filter is sufficient for compensating for the frequency response, e.g. of a sensor output signal $S_{OUT}$ from a sensor 230.

According to one exemplary embodiment, the digital calibration filter device 210 is configured to take the sensor-specific control signal $S_2$ as a basis for performing a recursive, digital filter processing of the digital input signal $S_1$.

According to present exemplary embodiments, temperature-dependent variations in the frequency response of an MEMS sound transducer or microphone are therefore minimized by means of dynamic, digital calibration.

According to exemplary embodiments, the digital calibration can optionally be performed in the circuit device 300 associated with the sensor arrangement. In general, the digital calibration or filtering can also be moved "to the rear" in the signal processing path and, by way of example, be effected in the program code (CODEC) of a device or mobile device. This exemplary embodiment is applicable when there is no information regarding the external influencing variable, such as e.g. the temperature of the sensor, in the sensor arrangement 310, but the mobile device is certainly able to provide this information. Further, the parameters for the calibration, i.e. the different sets of filter coefficients, can be stored in the circuit arrangement associated with the sensor or the sensor arrangement.

As such, according to exemplary embodiments, dynamic, digital calibration by means of the digital filter can compensate for or minimize temperature-dependent variations in the frequency response of the sensor, for example the microphone frequency response.

The corner simulations (edge frequency simulations) of an MEMS sound transducer show a maximum variation in the frequency response over temperature for low frequencies in FIGS. 1*a*-1*b*. The processing device 200 or circuit arrangement 300 with the digital filter path, depicted in FIGS. 2*a* and 3 in the form of a block diagram, can be used to perform compensation for temperature-dependent or any ambient-influence-dependent fluctuations in the frequency response. For the calibration, a programmable, digital filter 210 having the transfer function H(z) is used. This filter 210 can have three degrees of freedom, for example, i.e. a set comprising three filter coefficients. Further, the digital filter 210 may be configured as a recursive filter. The filter coefficients optimized for the individual borderline cases (cf. FIG. 2*b*) can be used to achieve the resultant amplitude response in FIG. 2*c*. By comparison, FIG. 1*b* once again depicts the amplitude response that has not been compensated for. It can clearly be seen that the amplitude responses that have been compensated for in FIG. 2*c* are almost perfectly congruent with the nominal amplitude response, the temperature $T_0$ of 25° C. being able to be assumed as nominal, for example.

The implementation of the calibration thus involves a digital filter with e.g. three programmable coefficients being employed. According to exemplary embodiments, it is further possible for the transfer function H(z) to be "fixed" with only very low performance losses for the coefficients $a_0$, in which case only two programmable coefficients are needed per set of filter coefficients. This allows further efficient implementation of the present calibration design.

Although some aspects have been described in connection with an apparatus, it goes without saying that these aspects are also a description of the corresponding method, which means that a block or a component of an apparatus is also intended to be understood as a corresponding method step or as a feature of a method step. Analogously, aspects described in connection with or as a method step are also a description of a corresponding block or detail or feature of a corresponding apparatus. Some or all of the method steps can be performed by a piece of hardware equipment (or using a piece of hardware equipment), such as, for example, a microprocessor, a programmable computer or an electronic circuit. In some exemplary embodiments, some or several of the most important method steps can be carried out by such a piece of equipment.

Depending on particular implementation requirements, exemplary embodiments of the invention may be implemented in hardware or in software or at least partially in hardware or at least partially in software. The implementation can be performed using a digital storage medium, for example a floppy disk, a DVD, a BluRay Disk, a CD, a ROM, a PROM, an EPROM, an EEPROM or a FLASH memory, a hard disk or another magnetic or optical memory storing electronically readable control signals that can interact or do interact with a programmable computer system such that the respective method is performed. Therefore, the digital storage medium may be computer-readable.

Some exemplary embodiments according to the invention thus comprise a data storage medium that has electronically readable control signals capable of interacting with a programmable computer system such that one of the methods described herein is performed.

Generally, exemplary embodiments of the present invention may be implemented as a computer program product with a program code, the program code being effective to perform one of the methods when the computer program product runs on a computer. The program code may also be stored on a machine-readable storage medium, for example.

Other exemplary embodiments comprise the computer program for performing one of the methods described herein, the computer program being stored on a machine-readable storage medium. In other words, an exemplary embodiment of the method according to the invention is therefore a computer program that has a program code for performing one of the methods described herein when the computer program runs on a computer.

A further exemplary embodiment of the methods according to the invention is therefore a data storage medium (or a digital storage medium or a computer-readable medium) on which the computer program for performing one of the methods described herein is recorded. The data storage medium or the digital storage medium or computer-readable medium is typically tangible and/or nonvolatile.

A further exemplary embodiment of the method according to the invention is therefore a data stream or a sequence of signals that constitutes or constitute the computer program for performing one of the methods described herein. The data stream or the sequence of signals can be configured, by way of example, to the effect of being transferred via a data communication connection, for example via the Internet.

A further exemplary embodiment comprises a processing device, for example a computer or a programmable logic component, which is configured or adapted to the effect of performing one of the methods described herein.

A further exemplary embodiment comprises a computer on which the computer program for performing one of the methods described herein is installed.

A further exemplary embodiment according to the invention comprises an apparatus or a system designed to transmit a computer program for performing at least one of the methods described herein to a receiver. The transmission can be effected electronically or optically, for example. The receiver may be a computer, a mobile device, a storage device or a similar apparatus, for example. The apparatus or the system can comprise a file server for transmitting the computer program to the receiver, for example.

In some exemplary embodiments, a programmable logic component (for example a field programmable gate array, an FPGA) can be used to perform some or all functionalities of the methods described herein. In some exemplary embodiments, a field programmable gate array can cooperate with a microprocessor in order to perform one of the methods described herein. Generally, the methods in some exemplary embodiments are performed on the part of an arbitrary hardware apparatus. The latter may be universally usable hardware such as a computer processor (CPU) or hardware specific to the method, such as an ASIC, for example.

It goes without saying that, in the detailed description above, when an element is referred to as "connected" or "coupled" to another element, it may be connected or coupled directly to the other element or there may be intermediate elements present. If, by contrast, an element is referred to as "connected" or "coupled" "directly" to another element, there are no intermediate elements present. Other expressions used to describe the relationship between elements should be interpreted in a similar manner (e.g. "between" as opposed to "directly between", "adjacent" as opposed to "directly adjacent", etc.).

The terminology used here is intended only to describe specific exemplary embodiments and is not intended to have a limiting effect for exemplary embodiments. According to usage herein, the singular forms "a, an" and "the" are also intended to encompass the plural forms, unless clearly indicated otherwise in the context. It furthermore goes without saying that the terms "comprises", "comprising", "have" and/or "having" in the usage herein indicate the presence of indicated features, integers, steps, operations, elements and/or constituents, but do not exclude the presence or addition of one or more other features, integers, steps, operations, elements, constituents and/or groups thereof.

Unless defined otherwise, all terms used here (including technical and scientific terms) have the same meaning as is normally understood by a person of average skill in the art in the field to which exemplary embodiments belong. Furthermore, it goes without saying that terms, e.g. those defined in dictionaries normally used, should be interpreted as having a meaning which corresponds to their meaning in the context of the corresponding technical area. However, if the present disclosure gives a term a specific meaning that deviates from a meaning such as is normally understood by a person of average skill in the art, said meaning should be taken into account in the specific context in which this definition is given.

In the detailed description above, in some instances different features have been grouped together in examples in order to rationalize the disclosure. This type of disclosure ought not be interpreted as the intention that the claimed examples have more features than are expressly indicated in each claim. Rather, as represented by the claims that follow, the subject matter can reside in fewer than all features of an individual example disclosed. Consequently, the claims that follow are hereby incorporated in the detailed description, wherein each claim can be representative of a dedicated separate example. While each claim can be representative of a dedicated separate example, it should be noted that although dependent claims refer back in the claims to a specific combination with one or more other claims, other examples also comprise a combination of dependent claims with the subject matter of any other dependent claim or a combination of each feature with other dependent or independent claims. Such combinations shall be encompassed, unless some explanation is given that a specific combination is not intended. Furthermore, the intention is for a combination of features of a claim with any other independent claim also to be encompassed, even if this claim is not directly dependent on the independent claim.

Although specific exemplary embodiments have been depicted and described herein, it will be obvious to a person skilled in the art that a multiplicity of alternative and/or equivalent implementations can be substituted for the specific exemplary embodiments shown and depicted therein without departing from the subject matter of the present application. This application text is intended to cover all adaptations and variations of the specific exemplary embodiments described and discussed herein. Thus, the present subject matter of the application is limited only by the wording of the claims and the equivalent embodiments thereof.

What is claimed is:

1. A system comprising:

a digital calibration filter device configured to receive a digital input signal based on a sensor output signal from a sensor, receive a sensor-specific control signal, and perform digital filter processing of the digital input signal to produce a calibrated output signal, wherein the digital filter processing is based on the sensor-specific control signal; and a control device configured to select the sensor-specific control signal from a plurality of predetermined sensor-specific control signals based on an ascertained influencing parameter, and provide the sensor-specific control signal to the digital calibration filter device, wherein each of the plurality of predetermined sensor-specific control signals comprises a set of predetermined sensor-specific filter coefficients configured to be used by the digital calibration filter device when performing the digital filter processing.

2. The system as claimed in claim 1, wherein the ascertained influencing parameter is a measured or estimated external influencing variable of the sensor that, in the event of a disparity from a predetermined value during operation of the sensor, causes a disparity in a frequency response of the sensor output signal from the sensor in relation to a prescribed frequency response of the sensor.

3. The system as claimed in claim 2, wherein:

the external influencing variable is a temperature of the sensor or a temperature of an ambient atmosphere of the sensor; or the external influencing variable is a present humidity, a present air pressure or a present gas concentration in the ambient atmosphere of the sensor.

4. The system as claimed in claim 1, wherein the influencing parameter is a measured or estimated, present temperature of the sensor that, in the event of a disparity from a predetermined temperature during operation of the sensor, causes a temperature-dependent disparity in a frequency response of the sensor in a predetermined frequency range in relation to a prescribed frequency response of the sensor.

5. The system as claimed in claim 4, wherein the prescribed frequency response of the sensor is a prescribed amplitude response, a prescribed phase response or a prescribed group delay in a prescribed frequency range.

6. The system as claimed in claim 1, wherein the digital calibration filter device is configured to compensate for a temperature-dependent disparity in a frequency response of the sensor in a prescribed frequency range.

7. The system as claimed in claim 1, wherein the control device is configured to receive temperature information, and select the sensor-specific control signal based on the received temperature information.

8. The system as claimed in claim 1, wherein the control device comprises a memory configured to store the plurality of sensor-specific control signals.

9. The system as claimed in claim 8, wherein the digital calibration filter device is a programmable recursive calibration filter configured to retain a programmable sensor-specific control signal until a further, different sensor-specific control signal is provided by the control device.

10. The system as claimed in claim 8, wherein the memory is configured to store a plurality of different sets of sensor-specific filter coefficients as the plurality of sensor-specific control signals for the digital calibration filter device, which are associated with different values from value ranges of the influencing parameter.

11. The system as claimed in claim 10, wherein the sensor-specific control signal provided by the control device comprises a set of sensor-specific filter coefficients for the digital calibration filter device, wherein the control device is further configured to provide the set of sensor-specific filter coefficients to the digital calibration filter device based on the influencing parameter.

12. The system as claimed in claim 10, wherein the digital calibration filter device has is configured to be programmed with at least two filter coefficients.

13. The system as claimed in claim 1, further comprising:

a sensor arrangement having a plurality of sensors, wherein each sensor of the plurality of sensor is configured to provide an analog sensor output signal, wherein a prescribed frequency response of at least one analog sensor output signal is altered in the event of a change in the influencing parameter.

14. The system as claimed in claim 13, wherein the sensor has a MEMS component, wherein the MEMS component is configured to provide the analog sensor output signal.

15. The system as claimed in claim 1, wherein the digital calibration filter device is configured as a recursive, digital calibration filter device.

16. The system of claim 1, wherein the digital calibration filter device is configured to filter only a single sensor output signal from a single sensor.

17. The system of claim 1, wherein the predetermined sensor-specific filter coefficients are determined prior to completion of manufacture of the system.

18. The system of claim 1, wherein the predetermined sensor-specific filter coefficients are determined during a backend test.

19. A mobile device comprising:

a sensor;

a digital calibration filter device coupled to the sensor, the digital calibration filter device configured to receive a digital input signal based on a sensor output signal from the sensor, receive a sensor-specific control signal, and perform digital filter processing of the digital input signal to produce a calibrated output signal, wherein the digital filter processing is based on the sensor-specific control signal;

a control device configured to select the sensor-specific control signal from a plurality of sensor-specific control signals based on an ascertained influencing parameter, and provide the sensor-specific control signal to the digital calibration filter device; and an influencing variable sensor device coupled to the control device, the influencing variable sensor device configured to provide the ascertained influencing parameter of the sensor to the control device, wherein each of the plurality of predetermined sensor-specific control signals comprises a set of predetermined sensor-specific filter coefficients configured to be used by the digital calibration filter device when performing the digital filter processing.

20. The mobile device as claimed in claim 19, wherein the digital calibration filter device and the control device is implemented on the sensor.

21. The mobile device as claimed in claim 20, further comprising a memory coupled to the control device, wherein the sensor comprises an interface configured to exchange of information with the control device and the memory, and to provide the sensor-specific control signal from the memory to the control device.

22. The mobile device as claimed in claim 19, wherein the digital calibration filter device is implemented using a processor configured to execute program code.

23. The mobile device as claimed in claim 19, wherein the influencing variable sensor device comprises a temperature sensor device thermally coupled to the sensor, and the temperature sensor device is configured to provide a temperature signal.

24. The mobile device of claim 19, wherein the sensor comprises a single sensor, and the digital calibration filter device is configured to filter only a single sensor output signal from a single sensor.

25. A method for calibrating a sensor output signal from a sensor, the method comprising:

ascertaining an influencing parameter of the sensor;

selecting a control signal from a plurality of predetermined control signals based on the ascertained influencing parameter, wherein the selected control signal comprises at least one digital filter coefficient, a prescribed frequency response of a digital filter is based on the at least one digital filter coefficient, and the control signal is dependent on the ascertained influencing parameter of the sensor;

adjusting a transfer function of the digital filter based on the selected control signal; and digital filtering an output signal of the sensor according to the adjusted transfer function to provide a calibrated output signal using the digital filter, wherein the digital filter utilizes at least two filter coefficients.

26. The method as claimed in claim 25, wherein ascertaining the influencing parameter comprises capturing a measured or estimated influencing variable of the sensor, wherein a disparity of the influencing variable from a predetermined value during operation of the sensor causes a disparity in a frequency response of the sensor in a prescribed frequency range in relation to the prescribed frequency response of the sensor.

27. The method as claimed in claim 25, further comprising:

storing different sets of sensor-specific filter coefficients for the digital filter in a memory, wherein the different sets of sensor-specific filter coefficients are associated with different values of the influencing parameter of the sensor, wherein the influencing parameter comprises a temperature or a temperature range; and selecting a set of sensor-specific filter coefficients for the digital filter based on a measured or estimated influencing parameter, and providing the selected set of sensor-specific filter coefficients to the digital filter as the selected control signal.

28. The method as claimed in claim 25, wherein the digital filter is configured as a recursive digital filter.

29. The method of claim 25, wherein digital filtering the output signal of the sensor comprises digital filtering an output signal of only a single sensor.

* * * * *